United States Patent [19]

Collins, Jr.

[11] Patent Number: 4,817,565

[45] Date of Patent: Apr. 4, 1989

[54] THERMALLY TURBULENT COMBUSTION SYSTEM

[75] Inventor: William G. Collins, Jr., Greensburg, Pa.

[73] Assignee: Westinghouse Electric Corp., Pittsburgh, Pa.

[21] Appl. No.: 197,175

[22] Filed: May 23, 1988

[51] Int. Cl.[4] ..... F22B 5/02

[52] U.S. Cl. ..... 122/197; 110/234; 122/6 A; 122/235 A

[58] Field of Search ..... 110/234; 122/6 A, 29, 122/190, 195, 197, 198, 199, 235 A, 235 J, 246

[56] References Cited

U.S. PATENT DOCUMENTS

| | | | |
|---|---|---|---|
| 1,319,700 | 10/1919 | Gould . | |
| 2,469,078 | 5/1945 | Robison . | |
| 3,822,651 | 7/1974 | Harris et al. . | |
| 4,066,024 | 1/1978 | O'Connor . | |
| 4,226,584 | 10/1980 | Ishikawa . | |
| 4,289,093 | 9/1981 | Coggins et al. | 122/197 |
| 4,437,418 | 3/1984 | Guillaume et al. . | |
| 4,497,281 | 2/1985 | Markus | 122/195 X |
| 4,615,283 | 10/1986 | Ciliberti et al. . | |

*Primary Examiner*—Edward G. Favors

[57] ABSTRACT

A thermally turbulent combustion system for combusting solid fuel which includes a generally cylindrical, longitudinally extending stationary combustion chamber formed by a plurality of interconnected circumferential cooling pipes and fuel transport means provided adjacent the bottom of the chamber along the length thereof. A water cooled door may be provided at the inlet end of the chamber. The width of the chamber is greater than the width of the fuel path. A plurality of headers are connected to the pipes to supply and discharge cooling fluid thereto and therefrom. In one embodiment, the combustion chamber has a symmetrical cross-sectional configuration and the transport means is positioned centrally along the length of the bottom thereof. In another embodiment of the system, the chamber has an asymmetrical cross-sectional configuration and the transport means is positioned adjacent one side along the length of the bottom of the chamber. The combustion system is useful as part of a balanced draft boiler system having forced air handling means and induced air handling means.

17 Claims, 3 Drawing Sheets

THERMALLY TURBULENT COMBUSTION SYSTEM

BACKGROUND OF THE INVENTION

1. Field of the Invention

The present invention is directed to a thermally turbulent combustion system for combusting solid fuels and, more particularly, to a combustion system that operates with turbulent gas flow caused by thermal convection which is capable of burning a wide variety of solid fuels including municipal wastes.

2. DESCRIPTION OF THE RELATED ART

Combustion systems utilizing solid fuels have long been known. For example, numerous types of combustors for solid waste materials have been employed for the disposal of municipal waste. Useful types of combustion systems of this type are described in U.S. Pat. Nos. 3,822,651 and 4,066,024. These types of combustion systems utilize a rotary kiln or drum that is formed by a plurality of longitudinally extending pipes that form an inner cylindrical surface. The pipes are adapted to accommodate the flow of water therethrough to cool the walls of the kiln and produce steam. Air is charged to the kiln through various means and combustion gases from the unit passed to a boiler for further production of steam. These types of combustion systems have been found very useful in waste disposal while providing revenue through generation of steam and electric power.

Certain of the known combustion systems require some type of forced agitation of combustion gases and air to accomplish mixing needed for complete combustion. These systems require careful design and operation, and often operate satisfactorily only over a relatively narrow range of conditions.

While such systems have proven useful in the processing of solid fuels such as municipal waste, the need still exists for a combustion system operable over a wide range of conditions which affords complete combustion of the fuel while still being relatively simple, efficient and economical in operation.

SUMMARY OF THE INVENTION

It is an object of the present invention to provide a thermally turbulent combustion system which enables complete combustion of solid fuels which operates with effective mixing over a wide range of operating conditions while still being relatively simple and economical in operation.

It is a further object of the present invention to provide a thermally turbulent combustion system for burning a wide variety of solid fuels such as municipal wastes which provides steam or other heat energy for use as an energy source.

The invention achieves the above objects by providing a thermally turbulent combustion system for combusting solid fuel which includes a generally cylindrical, longitudinally extending, stationary combustion chamber formed by a plurality of interconnected circumferential cooling pipes. The chamber has an inlet end, an outlet end, a top and sidewalls. A fuel supply opening is provided in the inlet end which may be closed by a water cooled door. Fuel transport means such as grate type conveying means are provided adjacent the bottom of the chamber along the length thereof for transporting fuel therethrough along a path parallel to the longitudinal axis of the chamber. The system further includes means for supplying combustion air to the chamber. The width of the chamber is greater than the width of the fuel path to facilitate thermal turbulence. A plurality of headers are connected to the pipes to supply and discharge cooling fluid thereto and therefrom. In one embodiment the chamber has a symmetrical cross-sectional configuration and the transport means is positioned centrally along the length of the bottom of the chamber. In another embodiment of the system, the chamber has an asymmetrical cross-sectional configuration and the transport means is positioned adjacent to one side along the length of the bottom of the chamber. The combustion system is useful as part of a balanced draft boiler system having forced air handling means and induced air handling means.

These, together with other objects and advantages, which will be subsequently apparent, reside in the details of the construction and operation of the invention as more fully described and claimed hereafter, reference being made to the accompanying drawings forming a part hereof, wherein like numerals refer to like parts throughout.

DESCRIPTION OF THE PREFERRED EMBODIMENTS

Figure 1:
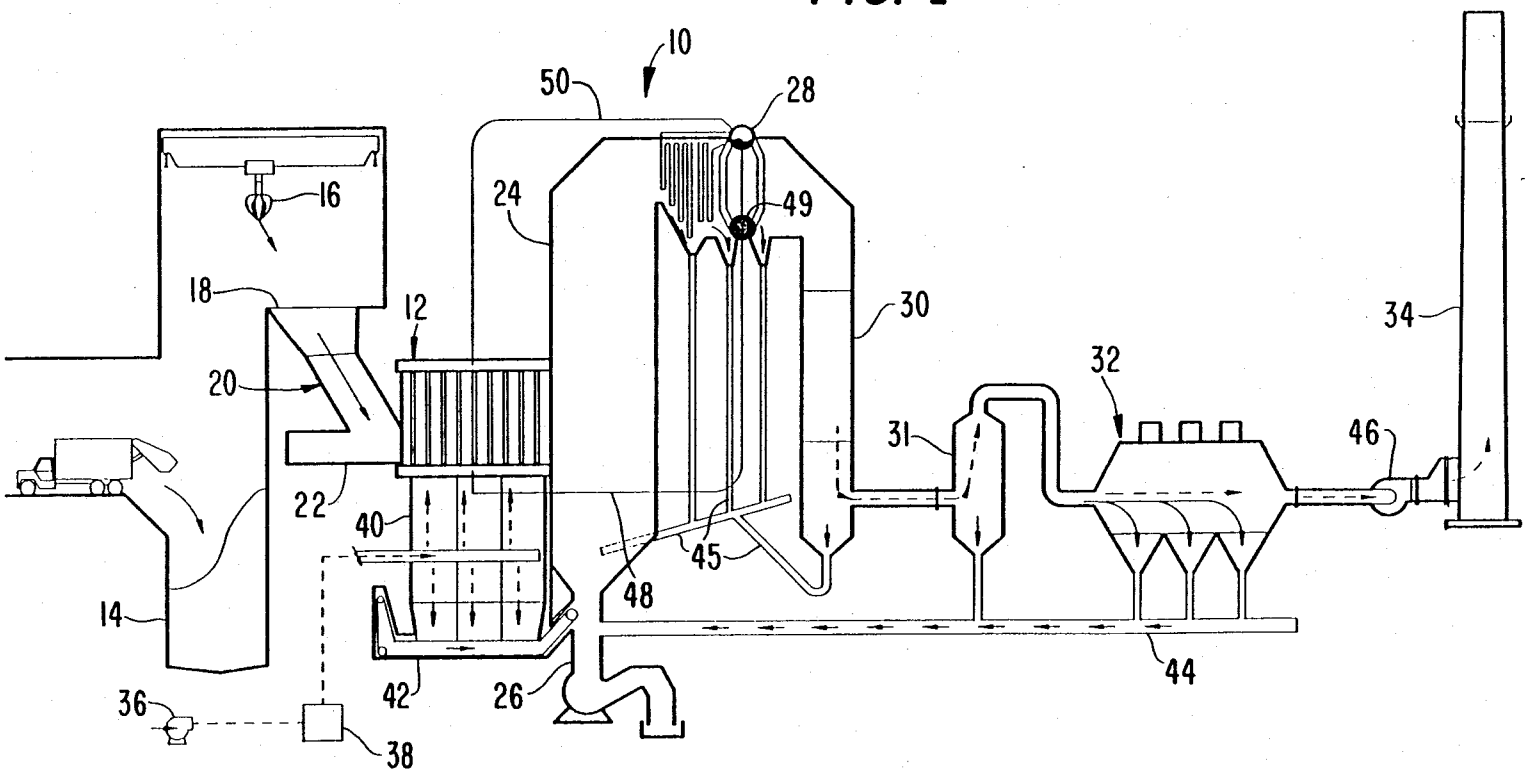
FIG. 1 is a schematic view of a balanced draft boiler system incorporating a combustion system according to the present invention.

Referring to the drawings, shown in FIG. 1 is a balanced draft boiler system, generally indicated by the numeral 10, having a thermally turbulent combustion system 12 according to the present invention incorporated therein. The balanced draft boiler system is useful in the combustion of solid fuels such as municipal waste.

The boiler system includes a receiving and storage pit 14 for the solid fuel 15 which is moved by a crane 16 to a charging hopper 18 from where the fuel is fed into a feed chute 20 leading to the combustion system 12. A feed ram 22 may be employed to facilitate charging the solid fuel into the combustion system 12. Ashes and hot combustion gases are discharged from the combustion system 12 to a water tube boiler 24 where the ashes fall to the bottom and are discharged through an ash discharge outlet 26. The hot gases rise and are used to produce steam in a steam drum 28 whereby the steam may be used as an appropriate energy source. The gases thereupon are passed through a feed water economizer 30 which removes additional heat from the gases after the gases have left the boiler. From the economizer the gases pass through a scrubber 31 and air pollution control equipment means 32, from where the gases are discharged to the atmosphere through a flue 34.

A forced draft fan 36 may be employed to force air for combustion through windboxes 40 into the combustion system 12. An air heater 38 may be provided to heat the incoming air prior to being fed to the windboxes. A siftings conveyor 42 may be provided underneath the windboxes 40 to collect siftings dropping from the combustion system 12 and discharge them into the ash discharge outlet 26. Similarly, a fly ash and scrubber solids removal conveyor 44 may be provided to collect fly ash and solids removed from the hot gases in the scrubber and the air pollution control equipment and convey them to the ash discharge outlet 26. Conduits 45 are provided to collect fly ash and solids from the gases as they pass through the steam drum and economizer regions and discharge them to the discharge outlet 26. An induced draft fan 46 may be provided between air pollution control equipment 32 and the flue 34 to facilitate the passage of the hot gases out through the flue.

Downcomer pipes 48 are employed to provide a coolant such as water from a suitable source such as a boiler drum 49, to the combustion system. A riser pipe 50 returns hot water and steam from the combustion system to the steam drum 28.

Figure 3:
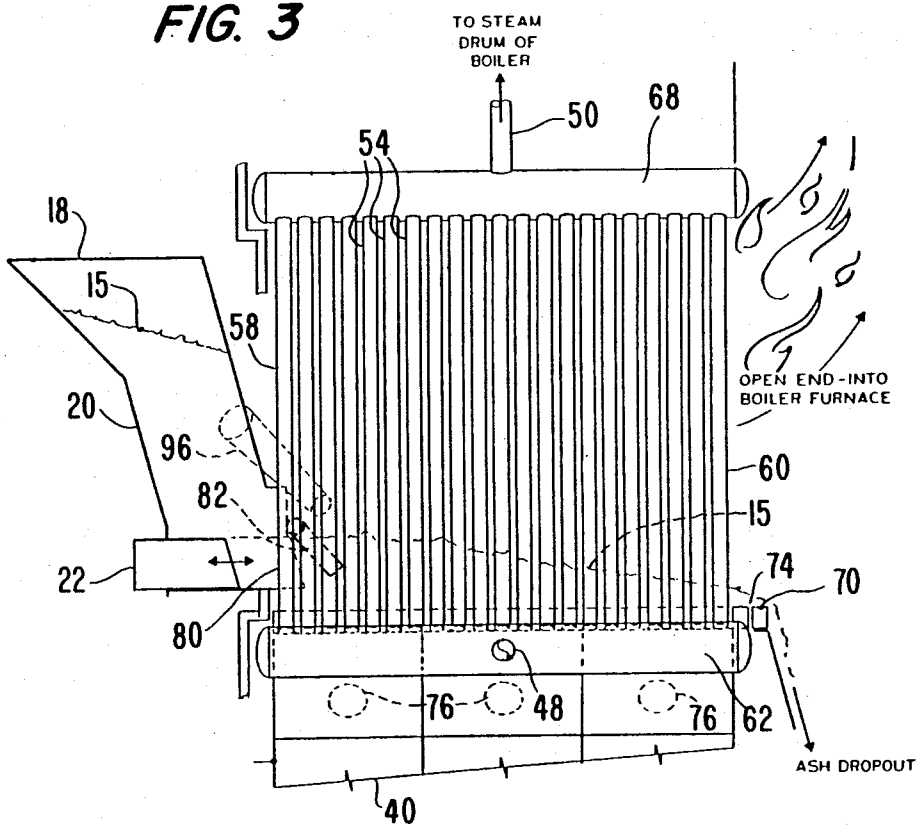
FIG. 3 is a side elevational view of the combustion system of FIG. 2.
Figure 2:
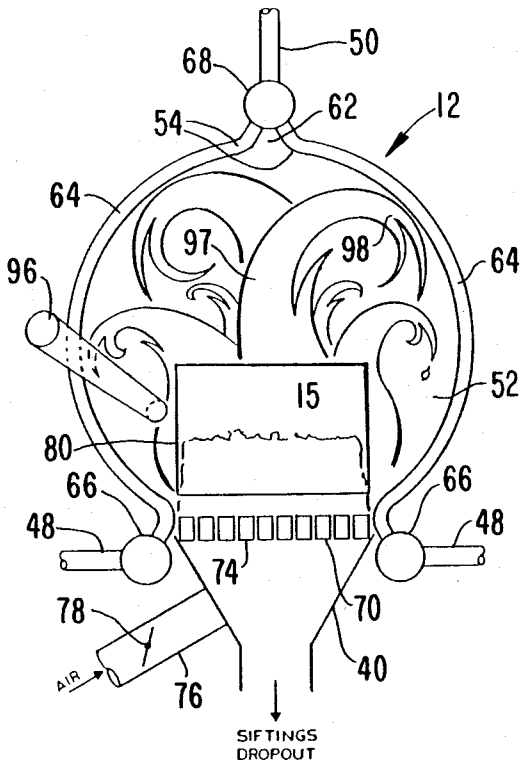
FIG. 2 is a schematic end view of a combustion system according to the present invention illustrating a symmetrical combustion chamber.

As best shown in FIGS. 2 and 3, one embodiment of the combustion system includes a generally cylindrical, longitudinally extending, stationary combustion chamber 52 formed by a plurality of interconnected circumferential cooling pipes 54. The cooling pipes 54 may be connected by solid webs 56 as shown in FIG. 2 to form a stationary chamber. Alternatively the combustion chamber may be formed solely from the cooling pipes being welded together without any webs therebetween. The important aspect is that the walls of the chamber be airtight. The chamber 52 has an inlet end 58, an outlet end 60, a top 62 and sidewalls 64. The chamber sidewalls and top are constructed of a thermally conductive material such as steel. The circumferential cooling pipes 54 shown in the drawings are vertical and lie in plane perpendicular to the longitudinal axis of the combustion chamber. As shown in FIG. 2, the chamber of this embodiment has a symmetrical cross-sectional configuration.

A longitudinally extending lower header 66 is provided adjacent the bottom along each side of the chamber 52 which is connected to the cooling pipes 54 and the downcomer pipe 48 to supply cooling fluid to the pipes. An upper header 68 adjacent the top of the chamber 52 is connected to the upper end of the pipes 54 to receive the heated coolant fluid and transmit it to the riser pipe 50 whereby the coolant is returned to the steam drum 28.

The combustion chamber 52 alternatively may be constructed with a plurality of longitudinally extending pipes around the circumference of the chamber rather than vertical pipes. In that case, the headers would be at the ends of the combustion chamber rather than at the top and bottom.

Fuel transport means 70 are provided adjacent the bottom of the combustion chamber 52 for transporting the fuel 15 therethrough along a path parallel to the longitudinal axis of the chamber. The fuel transport means preferably are in the form of a suitable conveyor means such as a travelling grate, a reciprocating grate or a vibratory grate. The fuel transport means 70 are provided with a plurality of openings 74 therein to permit the entry of combustion air into the combustion chamber up through the fuel along the length of the chamber. The combustion air may be supplied through a pipe 76 having a control damper 78 therein leading to each windbox 40 positioned underneath fuel transport means. The pipe 76 receives air from the forced draft fan 36 after it has passed through air heater 38. In the embodiment shown in FIG. 2, the fuel transport means is positioned centrally along the length of the bottom of the combustion chamber 52.

Figure 5:
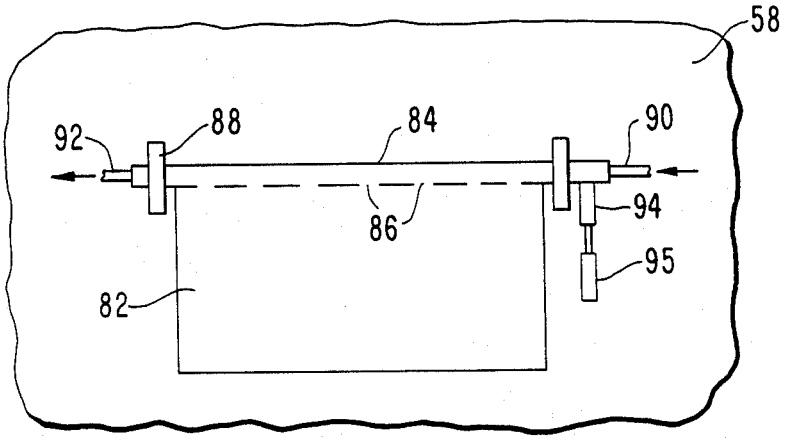
FIG. 5 is an enlarged partial end view showing a water cooled door inside at the inlet end of the combustion chamber.

The inlet end 58 of the combustion chamber is provided with a feed chute opening 80 for receiving fuel from the feed chute 20. As shown in FIGS. 3 and 5, a water cooled door 82 may be pivotally mounted on the inside of the wall of the inlet end 58 of the combustion chamber to close the feed chute opening 80. As best shown in FIG. 5, the door 82 is mounted to a hollow shaft 84 which is rotatably secured to the inlet end by brackets 88 having bearings therein. The door 82 has a hollow interior and the shaft 84 has a plurality of holes at the bottom thereof which communicate with the interior of the hollow door. Coolant such as water is supplied to the shaft by a pipe 90 at one end thereof whereby the coolant passes into the shaft 84 and down through the openings 86 into the interior of the door. The water circulates in the interior of the door, then exits out through the openings 82 back into the shaft 84 from where it exits through pipe 92.

The door 82 normally hangs down in a closed position with any suitable means such as a spring mechanism being employed to preload or tension the door to the closed position. When ram 22 is activated forwardly to push fuel into the interior of the combustion chamber, the ram pushes the door open as shown by the dashed lines in FIG. 3. Correspondingly, when the ram is moved backwardly, the tension on the door causes the door to automatically close. If desired, an additional mechanism may be utilized to open the door for access to the interior of the chamber when the ram is not in operation such as during inspection and/or maintenance activities. One suitable mechanism comprises an arm 94 extending out from one end of the hollow shaft 84 which is connected to a hydraulic cylinder 95. When the hydraulic cylinder is operated, it opens the door.

The water cooled door inhibits radiation from the combustion chamber from igniting the supply of fuel in the feed chute 20. The door also controls the supply of fuel into the chamber since it is preloaded so that it remains closed when the ram is not in operation. The door further fulfills the function of inhibiting the flow of uncontrolled air through the feed chute opening 80. An uncontrolled flow of air tends to interfere with the ability to control the combustion in the combustion chamber. In this regard, it is further noted that the supply of fuel normally in the feed chute inhibits entry of air through the feed chute opening.

An ignition burner 96 is mounted adjacent the inlet end 58 of the combustion chamber 54 to facilitate ignition of the fuel in the combustion chamber.

As shown in FIG. 2, the width of the combustion chamber 52 is greater than the width of the path of the fuel being transported by the fuel transport means 70, thereby enhancing thermal turbulence in the chamber. Burning of the fuel in the combustion chamber generates flame and hot gaseous products. The hot gaseous products are of low density because of their high temperature. The hot gaseous products give up heat by radiation and convection to the cool walls of the chamber. The combustion of the solid fuel such as municipal waste generates combustion temperatures exceedingly high, such as up to approximately 2500° F. On the other hand, the coolant passing through the pipes 54 lowers the temperature of the sidewalls 64 of the combustion chamber to approximately 500° F.

The cooling of the gaseous products by the coolant passing through the pipes 54 reduces the temperature of the gaseous products near the sidewalls, thus increasing their density. The difference in density between the flame and gases near and over the fuel 15 being burned, compared with the cooler, denser gases near the cool walls and roof of the chamber, causes the hotter gases to rise over the burning fuel while the cooler gas descend near the cool chamber walls. This establishes and drives one or more circulating patterns in the gas, as shown in FIG. 2. In FIG. 2, the hotter gases 97 rise over the burning fuel in the center of the chamber while the cooler gases 98 descend near the cool chamber walls. The flow of gases parallel to the chamber's longitudinal axis toward the outlet end 60 of the chamber combines with the circulating motion established by thermal convection to produce one or more vortexes in the gases in the chamber. These vortexes have their axes approximately parallel to the longitudinal axis of the combustion chamber 52. In this manner, a great amount of thermal turbulence is established in the combustion chamber 52.

Figure 4:
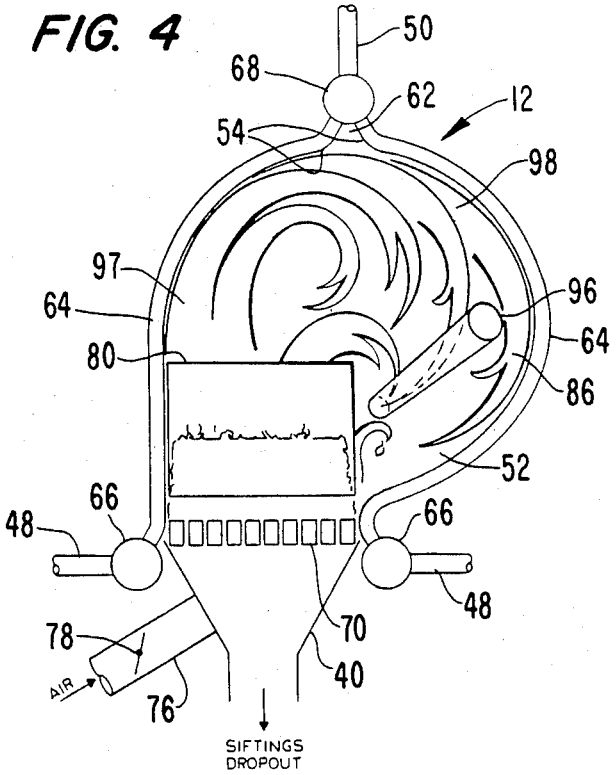
FIG. 4 is a schematic end view of another embodiment of a combustion system according to the present invention illustrating an asymmetrical combustion chamber.

In the embodiment of the combustion chamber 52 shown in FIG. 4, the chamber 52 has an asymmetrical cross-sectional configuration as opposed to the symmetrical cross-sectional configuration of the combustion chamber depicted in FIG. 2. The chamber of this embodiment, however, still is generally cylindrical with curved top and sidewalls. In this embodiment, the fuel transport means 70 is positioned adjacent one side along the length of the bottom of the chamber. In this manner, the sidewall 64 shown on the right hand side of the drawing is offset further to the side from the upper header than the sidewall 64 on the left hand side of the drawing. The operation of the combustion chamber shown in FIG. 4, however, is similar to the operation of the combustion chamber shown in FIG. 2 in that the hot gases 97 rising above the bed of fuel 72 are cooled by the pipes 54 whereby the cooler, denser gases 98 descend along the sidewalls on the right hand side of the chamber to establish a circular motion to produce one or more vortexes in the gases in the chamber.

The thermal turbulence established in the combustion chamber exists under an exceptionally wide range of operating conditions, as long as fuel is burning in the chamber and the walls and the roof of the chamber are being cooled. All combustion systems require turbulence to effectively mix combustible gases with air in order to achieve efficient combustion and minimize the release of unburned combustible gases. Other types of combustion systems must rely on mechanical effects such as a pressure drop in a furnace throat, or the stirring action of high velocity gas or air jets to promote turbulent mixing. These methods of forcing turbulent mixing must be carefully designed and operated in order to be effective, and can only remain effective over a relatively narrow range of operating conditions.

By contrast, the combustion system of the present invention does not require any such mechanical or forced effects to accomplish turbulent mixing of the gases with the air, but does it naturally as a basic characteristic of the design. The turbulent mixing thus established is effective and reliable over a wide range of operating conditions and does not require especially stringent control to remain effective.

Numerous alterations and modifications of the structure herein disclosed will suggest themselves to those skilled in the art. It is to be understood, however, that the present disclosure relates to the preferred embodiments of the invention which is for purposes of illustration only and is not to be construed as a limitation of the invention. All such modifications which do not depart from the spirit of the invention are intended to be included within the scope of the appended claims.

I claim:

1. A thermally turbulent combustion system comprising:

a generally cylindrical, longitudinally extending combustion chamber formed by a plurality of interconnected circumferential cooling pipes, said chamber having an inlet end, an outlet end, a top and sidewalls;

fuel transport means adjacent the bottom of said chamber for transporting fuel therethrough along a path parallel to the longitudinal axis thereof;

means for supplying combustion air to said chamber; and wherein the width of said chamber is greater than the width of said fuel path.

2. A combustion system as recited in claim 1 which includes headers connected to said pipes to supply and discharge cooling fluid thereto and therefrom.

3. A combustion system as recited in claim 2 wherein said headers comprise a lower header adjacent the bottom along each side of said chamber and an upper header adjacent the top of said chamber.

4. A combustion system as recited in claim 1 wherein said transport means comprises a grate type conveyor.

5. A combustion system as recited in claim 1 wherein said means for supplying combustion air includes a windbox adjacent said transport means whereby the air is supplied through said transport means.

6. A combustion system as recited in claim 1 wherein said chamber has a symmetrical cross sectional configuration and said transport means is positioned centrally along the length of the bottom of said chamber.

7. A combustion system as recited in claim 1 wherein said chamber has an asymmetrical cross sectional configuration and said transport means is positioned adjacent one side along the length of the bottom of said chamber.

8. A combustion system as recited in claim 1 which includes an ignition burner adjacent said chamber inlet end.

9. A combustion system as recited in claim 1 which includes an opening in said inlet end to receive fuel and a water cooled door closing said opening, said door being openable to permit fuel to be supplied to said chamber.

10. A combustion system as recited in claim 1 wherein said combustion system comprises part of a balanced draft boiler system having forced air handling means and induced air handling mean.

11. A thermally turbulent combustion system comprising:

a generally cylindrical, longitudinally extending combustion chamber formed by a plurality of interconnected circumferential cooling pipes, said chamber having an inlet end, an outlet end, a top and sidewalls;

headers connected to said pipes to supply and discharge cooling fluids thereto and therefrom, said headers comprising a lower header adjacent the bottom along each side of said chamber and an upper header adjacent the top of said chamber;

fuel transport means adjacent the bottom of said chamber for transporting fuel therethrough along a path parallel to the longitudinal axis thereof;

means for supplying combustion air to said chamber comprising a windbox adjacent said transport means whereby the air is supplied through said transport means; and wherein the width of said chamber is greater than the width of said fuel path.

12. A combustion system as recited in claim 11 wherein said transport means comprises a grate type conveyor.

13. A combustion system as recited in claim 11 wherein said chamber has a symmetrical cross sectional configuration and said transport means is positioned centrally along the length of the bottom of said chamber.

14. A combustion system as recited in claim 11 wherein said chamber has an asymmetrical cross sectional configuration and said transport means is positioned adjacent one side along the length of the bottom of said chamber.

15. A combustion system as recited in claim 11 which includes an ignition burner adjacent said chamber inlet end.

16. A combustion system as recited in claim 11 which includes an opening in said inlet end to receive fuel and a water cooled door closing said opening, said door being openable to permit fuel to be supplied to said chamber.

17. A combustion system as recited in claim 11 wherein said combustion system comprises part of a balanced draft boiler system having forced air handling means and induced air handling means.

* * * * *